US010194235B2

(12) United States Patent
Li

(10) Patent No.: US 10,194,235 B2
(45) Date of Patent: Jan. 29, 2019

(54) SPEAKER STRUCTURE WITH A LOADING HOLE

(71) Applicant: Shihuang Li, Singapore (SG)

(72) Inventor: Shihuang Li, Singapore (SG)

(73) Assignee: TGI TECHNOLOGY PTE LTD, Singapore (SG)

( * ) Notice: Subject to any disclaimer, the term of this patent is extended or adjusted under 35 U.S.C. 154(b) by 246 days.

(21) Appl. No.: 15/540,468

(22) PCT Filed: Jun. 19, 2013

(86) PCT No.: PCT/SG2013/000253
§ 371 (c)(1),
(2) Date: Jun. 28, 2017

(87) PCT Pub. No.: WO2014/007757
PCT Pub. Date: Jan. 9, 2014

(65) Prior Publication Data

US 2018/0007464 A1 Jan. 4, 2018

(30) Foreign Application Priority Data

Jul. 5, 2012 (CN) ..... 2012 1 0233205

(51) Int. Cl.
*H04R 1/28* (2006.01)
*H04R 1/30* (2006.01)

(52) U.S. Cl.
CPC ..... *H04R 1/2811* (2013.01); *H04R 1/2834* (2013.01); *H04R 1/2842* (2013.01);
(Continued)

(58) Field of Classification Search
None
See application file for complete search history.

(56) References Cited

U.S. PATENT DOCUMENTS 4,168,761 A 9/1979 Pappanikolaou
4,224,469 A * 9/1980 Karson ..... H04R 1/26 181/144

(Continued)

OTHER PUBLICATIONS

Huang et al, EPO translation of CN201523436. pp. 1-6. 7/72010.*

*Primary Examiner* — Thomas Maung
*Assistant Examiner* — Qin Zhu
(74) *Attorney, Agent, or Firm* — Hayes Soloway PC

(57) ABSTRACT

This invention discloses a kind of speaker structure with a loading hole. A characteristic is that it includes an active cavity that has a cone hole and a loading hole; a loudspeaker is sealed and secured on the said cone hole; the said active cavity is connected to the outside air through the said loading hole; the cone of the said loudspeaker has one side which is connected to the free space; another characteristic of this invention is that it includes a driven cavity that is connected to the said active cavity through the said loading hole; the cross-sectional area of the said loading hole is smaller than the cross-sectional area of the air passage on its either side; further, it is not larger than ⅔ the effective area of all the vibration units in the said active cavity; also, the volume of the said active cavity does not exceed half the total volume of the said active cavity and driven cavity. The loading hole constitutes a loading component which improves the transient response of the speaker body. To a great extent, it solves the contradiction between frequency response and transient effect at low sound frequencies. It lowers the requirements for the loudspeaker and simultaneously allows the frequency response and transient effect for the entire system at low sound frequencies to be handled relatively independently. This causes the loudspeaker cost to be reduced.

5 Claims, 2 Drawing Sheets

(52) U.S. Cl.
CPC ..... *H04R 1/2849* (2013.01); *H04R 1/2865* (2013.01); *H04R 1/30* (2013.01)

(56) References Cited

U.S. PATENT DOCUMENTS

| | | | | |
|---|---|---|---|---|
| 5,714,721 | A | 2/1998 | Gawronski et al. | |
| 6,504,938 | B1 | 1/2003 | Anderson et al. | |
| 7,136,498 | B1 | 11/2006 | Schott | |
| 7,252,176 | B2 * | 8/2007 | Moore | H04R 1/30 181/148 |
| 7,520,368 | B2 * | 4/2009 | Moore | H04R 1/30 181/152 |
| 2001/0012371 | A1 * | 8/2001 | Baumhauer | H04R 1/2842 381/345 |
| 2003/0228027 | A1 * | 12/2003 | Czerwinski | H04R 1/26 381/342 |
| 2004/0252859 | A1 | 12/2004 | Saiki | |
| 2009/0028370 | A1 * | 1/2009 | Matsumura | H04R 1/2803 381/386 |
| 2010/0142741 | A1 | 6/2010 | Plummer | |

* cited by examiner

SPEAKER STRUCTURE WITH A LOADING HOLE

TECHNICAL FIELD

This invention involves a kind of speaker structure with a loading hole.

BACKGROUND TECHNOLOGY

In the design of a speaker system, the frequency response and transient effect are two important parameters which affect listening. The former reflects the amplitude proportion restoration capability of the electric-acoustic conversion system in specific audio frequency bands while the latter reflects the delayed attenuation characteristic for audio frequency.

When an electric-acoustic conversion device such as the electromagnetic loudspeaker has sufficiently good frequency response in the low sound frequency range of tens of Hz, the vibration stroke of its diaphragms will definitely be larger. But as a result, its elasticity will become weaker and this will inevitably cause the transient effect to be poorer; by the same reasoning, for sounds in the low frequency range, should it be required for the transient response of the loudspeaker system to be sufficiently good, then its frequency response at lower frequencies will inevitably be attenuated. Therefore, for audio frequency electric-acoustic conversion devices, particularly for sounds in the low frequency band, the frequency response and transient effect are a contradiction which gets worse as the frequency decreases. In view of this phenomenon, this contradiction can be improved by designing a good loudspeaker which has adequate elasticity and whose cone has a sufficiently large vibration stroke. But along with this, the cost of the loudspeaker will inevitably be increased substantially. Moreover, there is limited room for improvement.

INVENTION CONTENT

Pertaining to the abovementioned problem of the difficulty in reconciling the mutual contradiction between frequency response and transient effect for sounds at low frequencies for the electric-acoustic conversion system, this invention proposes a kind of speaker structure with a loading hole. The technical plan is as follows:

The speaker structure with a loading hole includes:

An active cavity—The active cavity includes a cone hole and a loading hole; a loudspeaker is sealed and secured on the said cone hole; the said active cavity is connected to the outside air through the said loading hole; the cone of the said loudspeaker has one side which is connected to the free space;

A driven cavity—The driven cavity is connected to the said active cavity through the said loading hole; the cross-sectional area of the said loading hole is smaller than the cross-sectional area of the air passage on its either side; further, it is not larger than ⅔ the effective area of all the vibration units in the said active cavity; also, the volume of the said active cavity does not exceed half the total volume of the said active cavity and driven cavity.

The improvements for the basic technical plan above can be embodied in the following ways:

In a preferred embodiment, there is a partition board between the said active cavity and driven cavity. The said loading hole is located on this partition board. Further, the cross-sectional area of the said loading hole is smaller than the cross-sectional area of the said partition board on its either side between the said active cavity and driven cavity.

In a preferred embodiment, the said active cavity has a cone hole.

In a preferred embodiment, the said vibration units include the cone and passive diaphragms of the said loudspeaker; the said active cavity also includes at least one diaphragm hole. A said passive diaphragm is respectively secured on each said diaphragm; the said passive diaphragms and said active cavity are kept sealed.

In a preferred embodiment, the said active cavity has a buffer tube connected to it. The inner wall of this buffer tube gradually shrinks and stretches into the said driven cavity starting from the said active cavity; the inner wall of the said, buffer tube at its end continues to stretch while gradually expanding to form a speaker tube; the said loading hole is located where the said speaker tube and buffer tube connect at the smallest hole diameter.

In a preferred embodiment, the said driven cavity is a sealed type. Apart from its internal space that is connected to the said loading hole, the rest of its parts are kept sealed.

In a preferred embodiment, the said driven cavity is a phase inversion type. Apart from its internal space that is connected to the said loading hole, it is also connected to the outside free space through an internal phase inverter tube.

The beneficial effects of this invention are:

1. The loading hole strengthens the resistance to air flow and causes appropriate flow interference. It constitutes a loading component which improves the transient response of the speaker body. By setting the transient effect using the loading hole, it solves to a great extent the contradiction between frequency response and transient effect for low sound frequencies. It lowers the requirements for the loudspeaker and simultaneously allows the frequency response and transient effect for the entire system at low sound frequencies to be handled relatively independently. This causes the loudspeaker cost to be reduced.
2. By including the passive diaphragms in the active cavity, as well as due to the phase inverter tube in the driven cavity, high quality phase inversion is also achieved. Other than handling the frequency response and transient effect separately, the frequency response at low sound frequencies is also very prominent for the entire speaker body; at the same time, the frequency response at low sound frequencies can be enhanced by the passive diaphragms and phase inverter tube. This further lowers the requirements for the loudspeaker.

DESCRIPTION OF ATTACHED DIAGRAMS

The following diagrams and embodiments provide further explanation for this invention:

DESCRIPTION OF PREFERRED EMBODIMENTS

Figure 1:
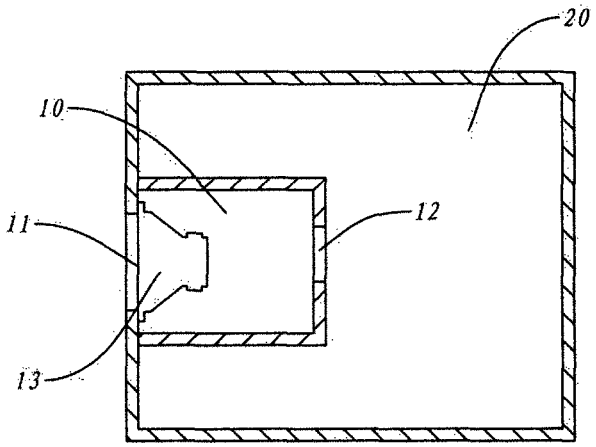
FIG. 1 is the cutaway view diagram for embodiment 1 of this invention.

Embodiment 1:

As shown in FIG. 1, this embodiment 1 uses the form of a sealed speaker. Driven cavity 20 occupies most of the space in the speaker body. There is a cone hole 11 on the speaker body. Where cone hole 11 is located, there is a smaller active cavity 10 in the speaker body. There is also a loading hole 12 on active cavity 10. When loudspeaker 13 is secured on cone hole 11 using the back loading method, active cavity 10 and loudspeaker 13 will form a sealed state. The outer cone surface of loudspeaker 13 is connected to the free space through cone hole 11. At the same time, active cavity 10 is only connected to the driven cavity 20 outside it through loading hole 12.

In this embodiment, the volume of active cavity 10 is ⅓ the volume of driven cavity 20. The cross-sectional area of loading hole 12 is ⅔ the cone area of loudspeaker 13. It is smaller than the cross-sectional area of the air passage on its either side.

And so, when the cone of loudspeaker 13 vibrates in its capacity as the sole vibration unit of this embodiment, the air within active cavity 10 becomes the load of its cone rear and returns to between active cavity 10 and driven cavity 20 through loading hole 12. Loading hole 12 is smaller than the cross-sectional area of the air passage on its either side. This strengthens the resistance to air flow and causes appropriate flow interference. It constitutes a loading component which improves the transient response of the speaker body. This causes the transient response of the entire speaker body to be no longer unconstrained by loudspeaker 13, particularly at low sound frequencies. Therefore, by setting the frequency response of loudspeaker 13 itself and setting the transient effect using loading hole 12, the constraint factors for frequency response and transient effect are separated for low sound frequencies. To a great extent, this solves the contradiction between frequency response and transient effect at low sound frequencies. It lowers the cone requirements for loudspeaker 13 and simultaneously allows the frequency response and transient effect for the entire system at low sound frequencies to be handled relatively independently. This causes the loudspeaker cost to be reduced. Driven cavity 20 of this embodiment is a sealed type. Apart from loading hole 12 that is connected to active cavity 10, the rest of its parts are kept sealed. It is suitable for the design of a sealed type speaker.

Figure 2:
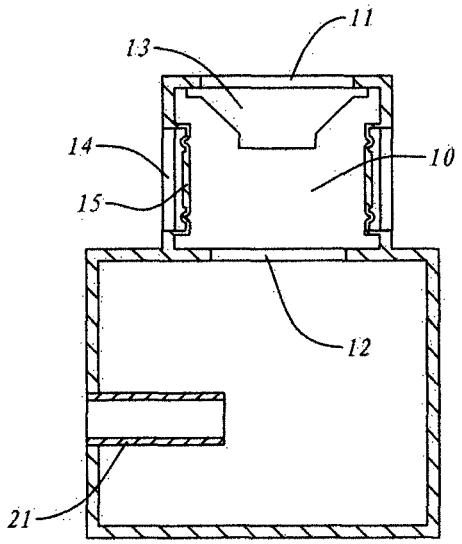
FIG. 2 is the cutaway view diagram for embodiment 2 of this invention.

Embodiment 2:

As shown in FIG. 2, driven cavity 20 of this embodiment is a phase inversion type. For driven cavity 20, apart from being connected through loading hole 12 to active cavity 10 outside it, it also has a phase inverter tube 21 connected to the outside free space.

There is a cone hole 11 on active cavity 10 and loudspeaker 13 is similarly secured using the back loading method. However for the entire active cavity 10, apart from the cone of loudspeaker 13, there are still two passive diaphragms 15 jointly functioning as vibration units. Each passive diaphragm 15 is secured on diaphragm hole 14 and kept sealed with the active cavity. In this embodiment, the cross-sectional area of loading hole 12 is ¼ the cross-sectional area of all the vibration units i.e. the cone of loudspeaker 13 and all the passive diaphragms 15.

This embodiment is suitable for the design of the phase inversion type speaker body. Relative to embodiment 1, passive diaphragms 15 are included in active cavity 10 to achieve high quality phase inversion as well as improve sound effects at low frequencies; at the same time, the phase inverter tube of driven cavity 20 also causes high quality phase inversion. Other than handling the frequency response and transient effect separately, the frequency response at low sound frequencies is also very prominent for the entire speaker body; at the same time, the frequency response at low sound frequencies can be enhanced by passive diaphragms 15 and phase inverter tube 21. This further lowers the requirements for loudspeaker 13.

Figure 3:
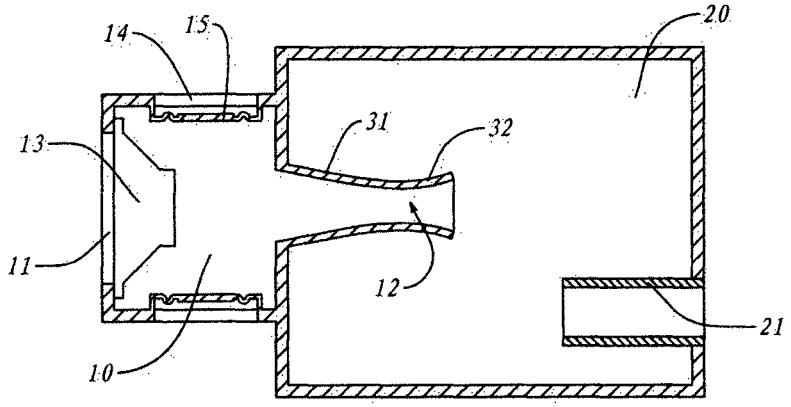
FIG. 3 is the cutaway view diagram for embodiment 3 of this invention.

Embodiment 3:

As per FIG. 3, the cutaway view diagram for embodiment 3 of this invention. Active cavity 10 in this embodiment 3 is similar to the case for embodiments 1 and 2. It has cone hole 11 and back loaded loudspeaker 13. Further, it has diaphragm hole 14 that secures passive diaphragms 15. At the same time, driven cavity 20 also has a phase inverter tube 21. The difference is that loading hole 12 is no longer a hole cut out on a partition board like the case for embodiments 1 and 2. Instead, there is a buffer tube 31 on active cavity 10 that is connected to it. The inner wall of this buffer tube gradually shrinks and stretches into driven cavity 20 starting from active cavity 10. At the same time, the inner wall of buffer tube 31 at its end continues to stretch while gradually expanding to form a speaker tube 32; loading hole 12 is located where speaker tube 32 and buffer tube 31 connect at the smallest hole diameter. As can be seen, active cavity 10 also includes the space of buffer tube 31. However, the space in speaker tube 32 belongs to driven cavity 20. Similarly, loading hole 12 is smaller than the cross-sectional area of the air passage on its either side. When the vibration units in active cavity 10 start operating, the air will be pressurized to return to the loading hole as load. At the same time, the form of both buffer tube 31 and speaker tube 32 is such that the inner diameter gradually changes. The air turbulence is little and the air flow is stable. The transient distortion is relatively small.

Figure 4:
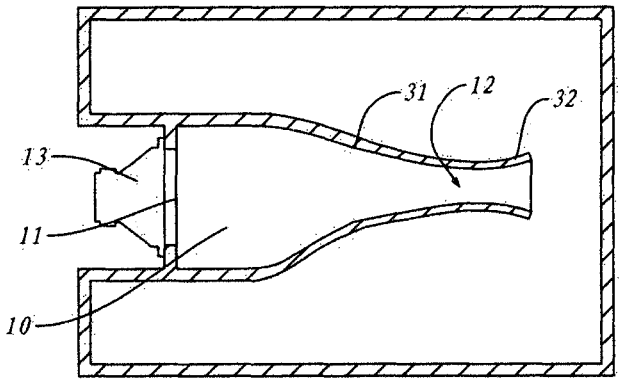
FIG. 4 is the cutaway view diagram for embodiment 4 of this invention.

Embodiment 4:

As per FIG. 4, the cutaway view diagram for embodiment 4 of this invention. In this embodiment, a front loaded loudspeaker 13 is secured on cone hole 11 of active cavity 10. The cone of loudspeaker 13 directly acts on the internal air of active cavity 10. At the same time, along the path of the cone vibration side of loudspeaker 13 that is oriented toward loading hole 12, there is a gradually changing buffer tube 31 and a speaker opening 32. The inner container wall along this path changes continuously and there are no sudden inflection points. When the air moves to and fro into buffer tube 31 and speaker opening 32, the turbulence caused by air loading is at the minimum. There is very stable transient effect.

The description above only covers the preferred embodiments of this invention and it is not meant to limit its implementation scope i.e. any equivalent changes or modifications made within the patent scope of this invention or based on its specification content should all fall within the scope of this invention.

The invention claimed is:

1. A speaker structure with a loading hole comprising:

an active cavity, which includes a cone hole and a loading hole, wherein the cone hole and loading hole are each affixed to a portion of the active cavity;

a loudspeaker sealed and secured to the cone hole in the active cavity, wherein the loudspeaker has a cone that is at least partially in direct contact with a portion of the active cavity;

a driven cavity connected to the active cavity through the loading hole, wherein a cross-sectional area of the loading hole is smaller than a cross-sectional area of the outside air connection and the active cavity is not larger than ⅔ the effective area of the vibration units in the active cavity and wherein, the volume of the active cavity does not exceed half the total volume of a combination of the active cavity and the driven cavity;

a buffer tube connected to the active cavity, wherein the buffer tube has a cross-sectional area that decreases as it extends from the active cavity into the driven cavity and the buffer tube terminates in a distal end; and a speaker tube connected to the distal end of the buffer tube, wherein the speaker tube has a cross-sectional area that increases as it extends from the buffer tube and the loading hole is located in a space where the speaker tube and the buffer tube connect.

2. The speaker structure with the loading hole of claim 1, further comprising a partition board that separates the active cavity and driven cavity and houses the loading hole wherein the cross-sectional area of the loading hole is smaller than the cross-sectional area of the partition board.

3. The speaker structure with the loading hole of claim 1, wherein the vibration units include a cone and passive diaphragm of the loudspeaker and wherein the active cavity also includes-at least one diaphragm portion; the passive diaphragm is secured on the diaphragm and the active cavity are kept sealed.

4. The speaker structure with the loading hole of claim 1, wherein the driven cavity is a sealed type apart from being connected to the active cavity through the loading hole.

5. The speaker structure with the loading hole of claim 1, wherein the driven cavity is a phase inversion type and is in direct contact with an exterior portion of the speaker structure through an internal phase inverter tube.

* * * * *